US006533166B1

(12) United States Patent
Kaiss

(10) Patent No.: US 6,533,166 B1
(45) Date of Patent: Mar. 18, 2003

(54) TRANSACTION SLIP ORGANIZER

(76) Inventor: Wassim Kaiss, 11152-30 Ave., Edmonton AB (CA), T6J-3X9

( * ) Notice: Subject to any disclaimer, the term of this patent is extended or adjusted under 35 U.S.C. 154(b) by 66 days.

(21) Appl. No.: 09/850,566

(22) Filed: May 7, 2001

Related U.S. Application Data

(63) Continuation-in-part of application No. 09/657,374, filed on Sep. 8, 2000, now abandoned.

(51) Int. Cl.[7] ..... B65D 91/00
(52) U.S. Cl. ..... 232/1 D; 206/425; 220/552
(58) Field of Search ..... 232/1 D; 206/425, 206/561; 220/533, 532, 552, 528, 553, 529; 190/109, 110

(56) References Cited

U.S. PATENT DOCUMENTS 2,695,112 A * 11/1954 Bonnevay ..... 217/7
3,656,650 A * 4/1972 Frater ..... 220/553
3,710,900 A * 1/1973 Fink ..... 206/387.15
4,234,089 A * 11/1980 Morris ..... 206/456
4,629,066 A * 12/1986 Howard ..... 206/387.15
4,779,752 A * 10/1988 Vallee et al. ..... 220/533
4,837,590 A * 6/1989 Sprague ..... 346/145
4,927,016 A * 5/1990 Fuller ..... 206/315.11
5,096,056 A * 3/1992 Garcia ..... 206/479
5,238,112 A * 8/1993 Massey et al. ..... 206/387.15
5,297,674 A * 3/1994 Birutis et al. ..... 206/214
5,299,688 A * 4/1994 McKay et al. ..... 206/425
5,427,446 A * 6/1995 Glomski ..... 312/242
5,651,596 A * 7/1997 Carlson et al. ..... 312/334.46
5,788,073 A * 8/1998 Suryk ..... 206/425
5,823,424 A * 10/1998 Allen ..... 229/120.07
5,839,553 A * 11/1998 Dorsam ..... 190/109

* cited by examiner

*Primary Examiner*—William L. Miller

(57) ABSTRACT

A transaction slip organizer system comprises a rectilinear box with an open top. A plurality of plates is located in the box. A pair of end plates comprises a rear plate having a rear face secured to the forward face of the rear wall and a front plate having a front face secured to the rearward face of the front wall. A plurality of intermediate plates is provided. The intermediate plates are located parallel with and spaced from the front and rear plates. Also provided is a plurality of dividers. Each divider has a lower edge positionable on the bottom wall of the box and an upper edge adjacent to the top of the box. Each divider has at least one lateral edge. One of the end plates defines a plurality of small chambers between adjacent dividers.

5 Claims, 7 Drawing Sheets

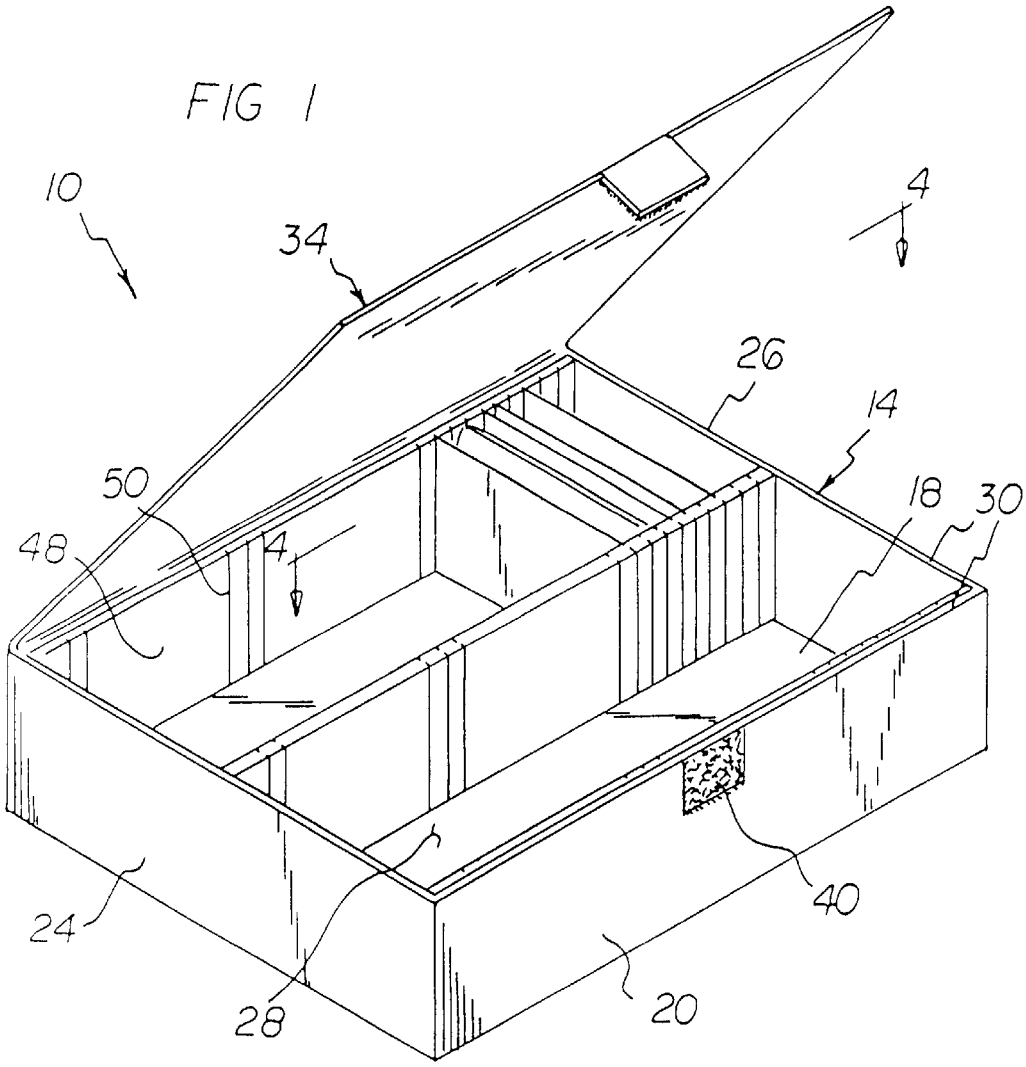
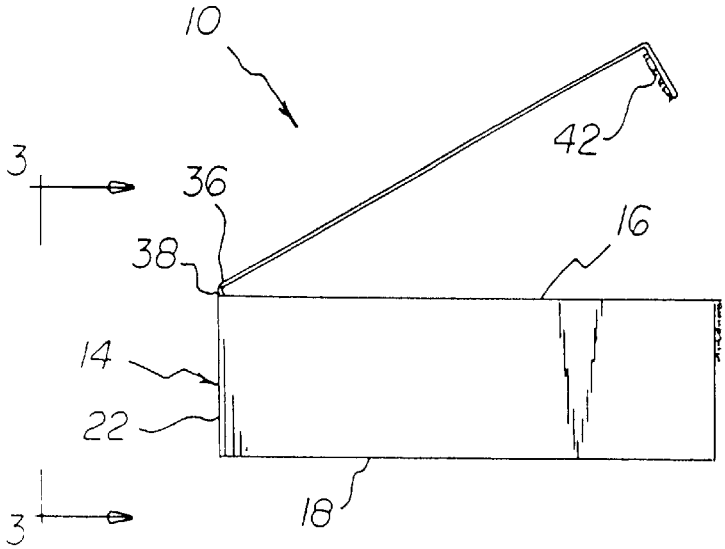
FIG 2

FIG 3
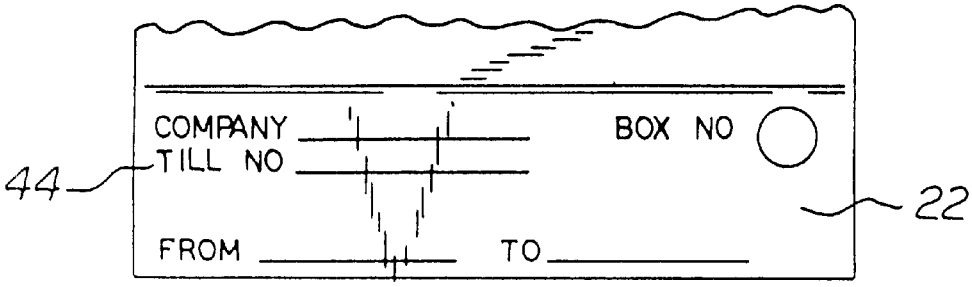
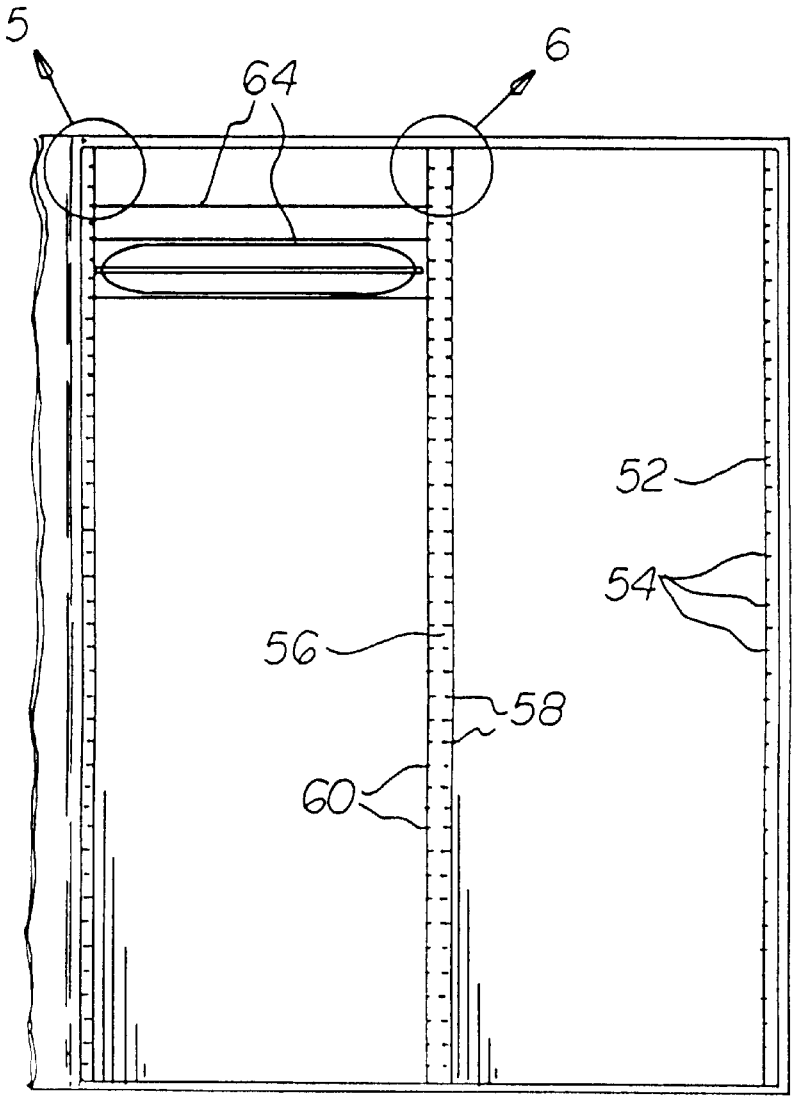
FIG 4

FIG 11
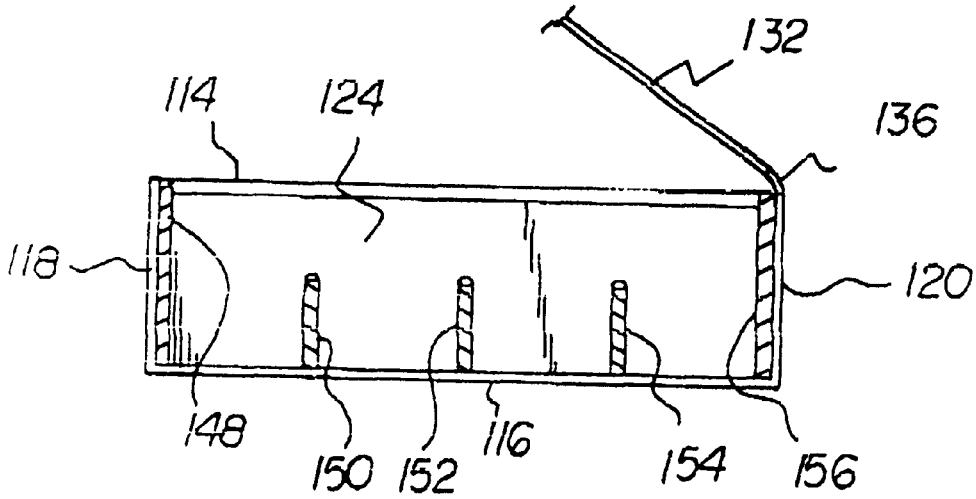
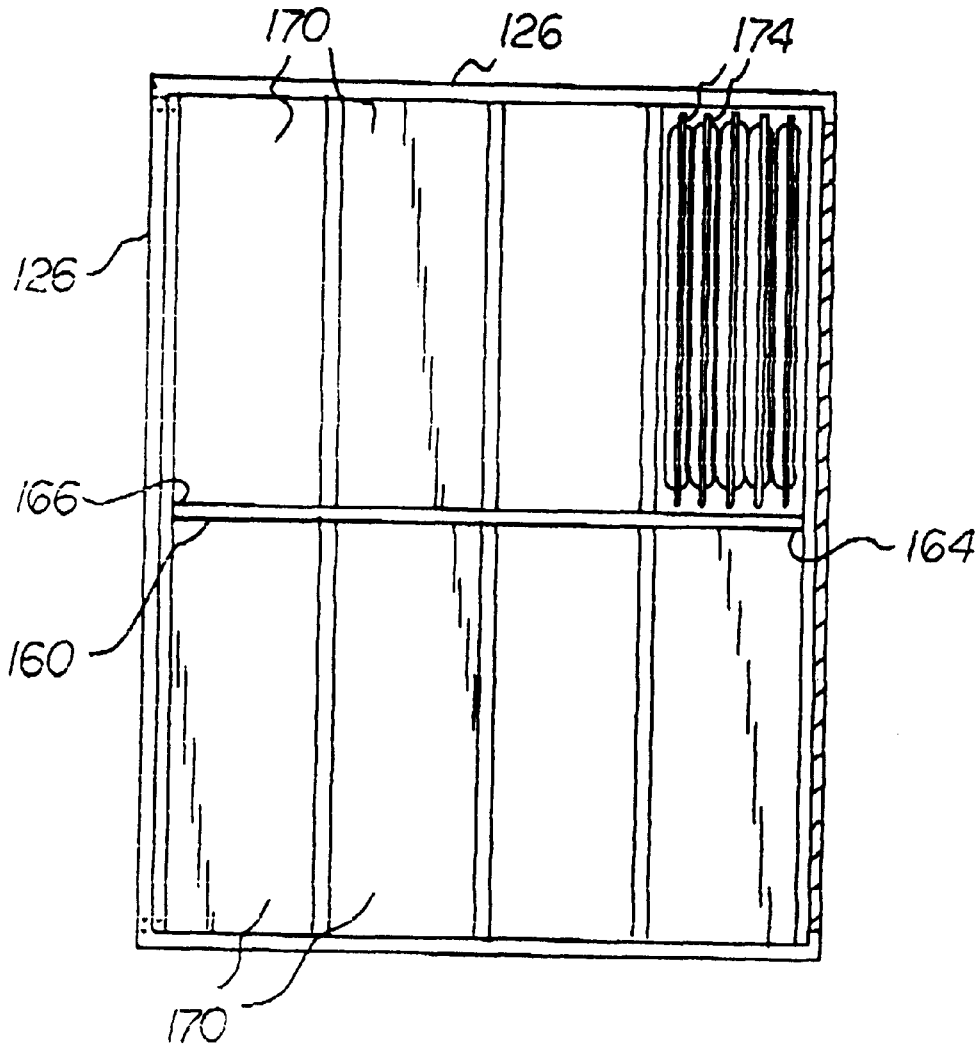
FIG 12

TRANSACTION SLIP ORGANIZER

RELATED APPLICATION

This application is a Continuation in Part of application Ser. No. 09/657,374 filed Sep. 8, 2000, now abandoned.

BACKGROUND OF THE INVENTION

1. Field of the Invention

The present invention relates to a transaction slip organizer and more particularly pertains to a transaction slip organizer and more particularly to proper storing and retrieving merchants' copies of transaction slips in a more efficient and convenient manner.

2. Description of the Prior Art

The use of storage systems of known designs and configurations is known in the prior art. More specifically, storage systems of known designs and configurations previously devised and utilized for the purpose of organizing merchant's copies of transaction slips through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,656,650 to Frater discloses a compartmentalized container. U.S. Pat. No. 5,299,688 to McKay et al. discloses a storage devise and system for card collections. U.S. Pat. No. 4,779,752 to Vallee et al. discloses a portable filing box. U.S. Pat. No. 5,427,446 to Glomski discloses a sound recording storage cabinet. Lastly, U.S. Pat. No. 5,651,596 to Carlson et al. discloses a modular drawer with variable depth.

While these devices fulfill their respective, particular objectives and requirements, the aforementioned patents do not describe a transaction slip organizer that allows proper storing and retrieving merchant's copies of transaction slips in a more efficient and convenient manner.

In this respect, the transaction slip organizer according to the present invention substantially departs from the conventional concepts and designs of the prior art, and in doing so provides an apparatus primarily developed for the purpose of proper storing and retrieving merchant's copies of transaction slips in a more efficient and convenient manner.

Therefore, it can be appreciated that there exists a continuing need for a new and improved transaction slip organizer which can be used for proper storing and retrieving merchant's copies of transaction slips in a more efficient and convenient manner. In this regard, the present invention substantially fulfills this need.

SUMMARY OF THE INVENTION

In view of the foregoing disadvantages inherent in the known types of storage systems of known designs and configurations now present in the prior art, the present invention provides an improved transaction slip organizer. As such, the general purpose of the present invention, which will be described subsequently in greater detail, is to provide a new and improved transaction slip organizer and method which has all the advantages of the prior art and none of the disadvantages.

To attain this, the present invention essentially comprises a rectilinear box. The rectilinear box has a rectangular open top and a rectangular horizontal lower imperforate bottom wall. The box also has a long vertical front wall forwardly and a parallel long rear vertical wall rearwardly. Short parallel vertical side walls are provided between the front and rear walls to define a rectilinear large chamber. Each of the vertical walls has an upper edge terminating at the open top. The front wall has side edges with vertical slots adjacent to the side walls. An imperforate rectangular lid is further provided. The lid is adapted to selectively cover and uncover the open top. The lid has a rear edge. The rear edge has a hinge coupled to the upper edge of the rear wall of the box. The lid also has a front edge. The front edge has a flap and a hinge coupled between the flap and the front edge and has side edges. The side edges have flanges adjacent to the thereto. The flanges are adapted to removably reside in the associated slots of the box when the lid is in a closed orientation. Indicia are formed on the rearward exterior surface of the rear wall. Also provided are five vertical plates. Each vertical plate has a lower edge positionable on the bottom wall of the box. The first plate and the last plate each have an upper edge adjacent to the open top of the box and intermediate plates. Each intermediate plate has an upper edge extending upwardly to a distance less than the open top. All the plates have side edges adjacent the side wall of the box. Even further provided is a vertical support divider. The vertical support divider is located within the box. The divider includes a rear edge. The rear edge is secured by an adhesive to the forward face of the rear wall of the box. In a similar fashion, the front edge is secured by an adhesive to the rear face of the front wall. The divider is formed with vertical parallel finger-like slots equally spaced along a bottom portion. The support divider is adapted to lie between the first plate and last plate. The slots receive the intermediate plates. In this manner, all the plates and the support divider retain a vertical configuration with two rows of small chambers with four small chambers in each row. Last provided is a plurality of envelopes. The envelopes are adapted to receive merchants' copies of daily transaction slips for credit cards and debit cards. The envelopes are of a size less than an associated small chamber. This allows the envelopes to be received between adjacent plates. Indicia are formed on each envelope for identification purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved transaction slip organizer which has all of the advantages of the prior art storage systems of known designs and configurations and none of the disadvantages.

It is another object of the present invention to provide a new and improved transaction slip organizer which may be easily and efficiently manufactured and marketed.

It is further object of the present invention to provide a new and improved transaction slip organizer which is of durable and reliable constructions.

An even further object of the present invention is to provide a new and improved transaction slip organizer which is susceptible of a low cost of manufacture with regard to both materials and labor, and which accordingly is then susceptible of low prices of sale to the consuming public, thereby making such transaction slip organizer economically available to the buying public.

Even still another object of the present invention is to provide a transaction slip organizer for proper storing and retrieving merchant's copies of transaction slips in a more efficient and convenient manner.

Lastly, it is an object of the present invention to provide a new and improved transaction slip organizer system comprising a rectilinear box with an open top. A plurality of plates is located in the box. A pair of end plates comprises a rear plate having a rear face secured to the forward face of the rear wall and a front plate having a front face secured to the rearward face of the front wall. A plurality of intermediate plates is provided. The intermediate plates are located parallel with and spaced from the front and rear plates. Also provided is a plurality of dividers. Each divider has a lower edge positionable on the bottom wall of the box and an upper edge adjacent to the top of the box. Each divider has at least one lateral edge. One of the end plates defines a plurality of small chambers between adjacent dividers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the new and improved transaction slip organizer constructed in accordance with the principles of the present invention.

FIG. 2 is a side elevational view of the system shown in FIG. 1.

FIG. 3 is a rear elevational view taken along line 3—3 of FIG. 2.

FIG. 4 is a top elevational view of the system of the prior Figures taken along line 4—4 of FIG. 1.

FIG. 11 is a side elevational view of the system shown in FIG. 9 taken along line 11—11 of FIG. 10.

FIG. 12 is a top plan view of the system shown in FIG. 9 showing transaction slips in one of the chambers.

The same reference numerals refer to the same parts throughout the various Figures.

DESCRIPTION OF THE PREFERRED EMBODIMENT

Figure 5:
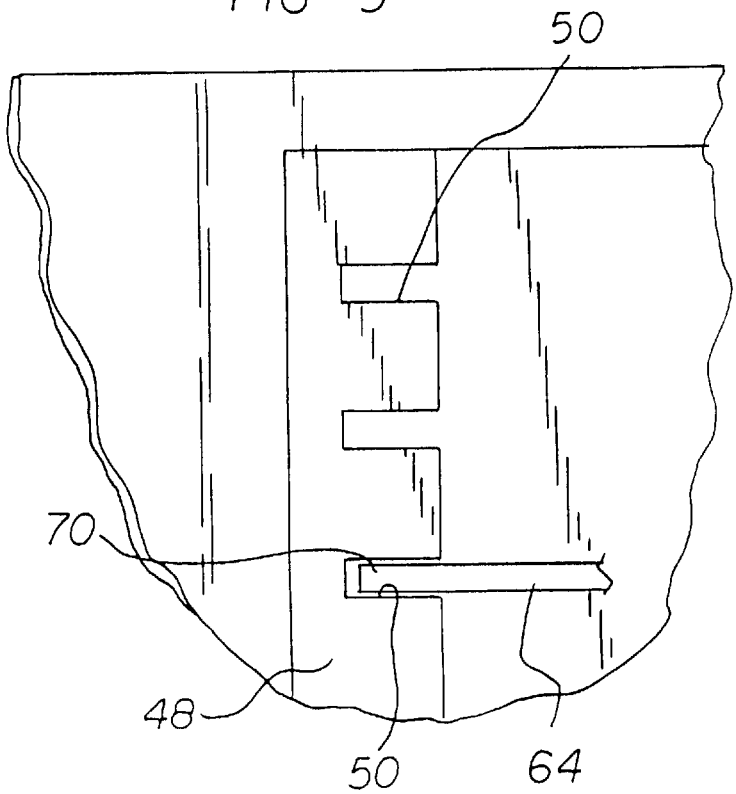
FIG. 5 is an enlarged top view taken at circle 5 of FIG. 4.
Figure 6:
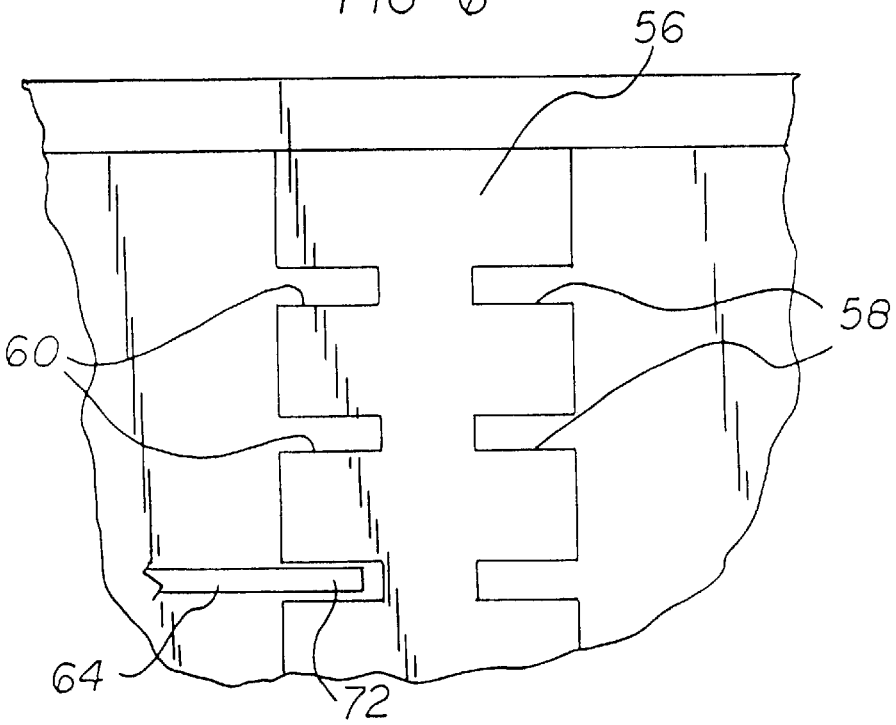
FIG. 6 is an enlarged top view taken at circle 6 of FIG. 4.
Figure 7:
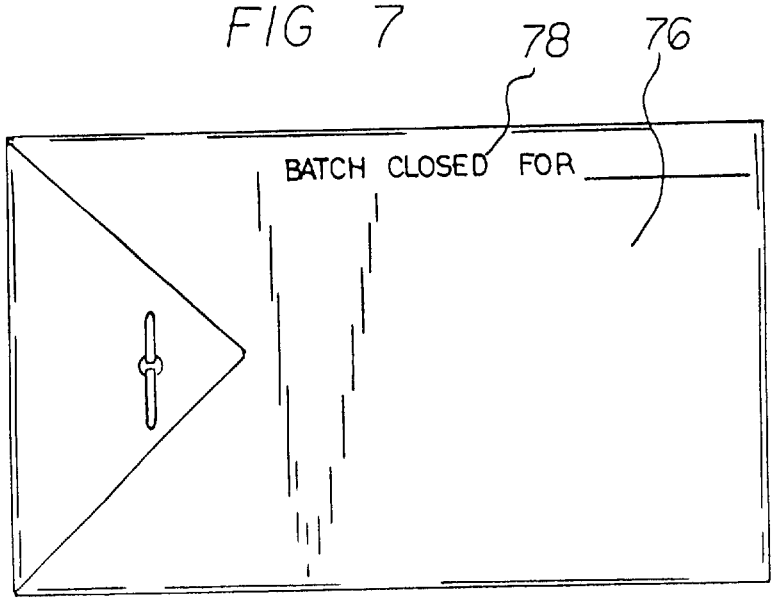
FIG. 7 is a front elevational view of one of the envelopes located within the box of FIG. 1.
Figure 8:
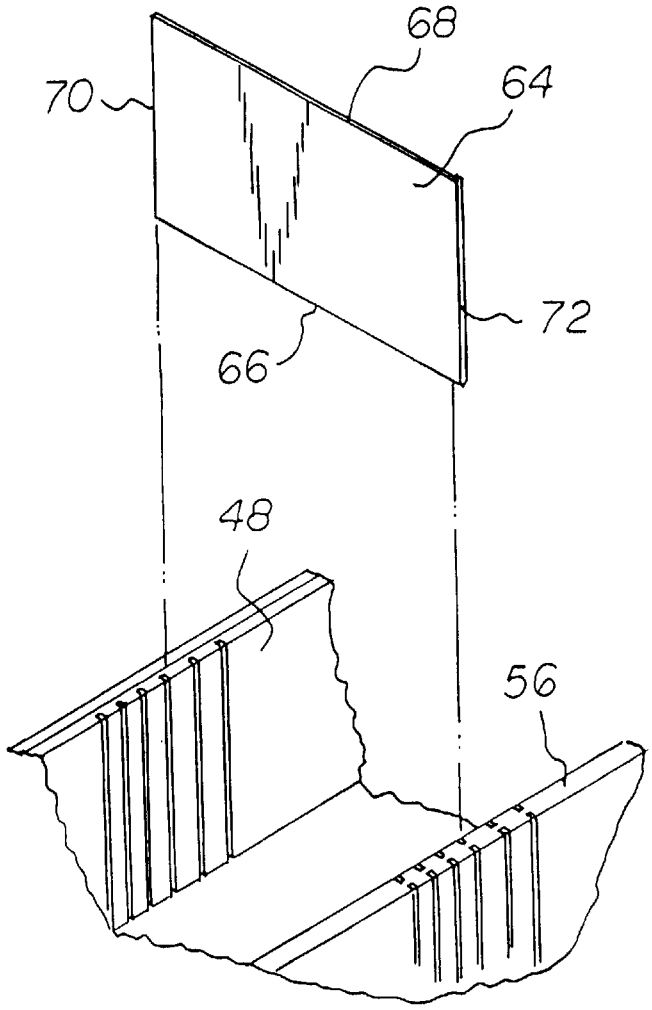
FIG. 8 is perspective illustration of a portion of the box showing one of the dividers in an elevated orientation.

With reference now to the drawings, and in particular to FIG. 1 thereof, the preferred embodiment of the new and improved transaction slip organizer embodying the principles and concepts of the present invention and generally designated by the reference numeral 10 will be described.

The present invention, the transaction slip organizer 10 is comprised of a plurality of components. Such components in their broadest context include a rectilinear box, a plurality of support plates, and a plurality of dividers. Such components are individually configured and correlated with respect to each other so as to attain the desired objective.

First provided is a rectilinear box 14. The box has a rectangular open top 16. The box has a rectangular horizontal lower imperforate bottom wall 18. A long vertical front wall 20 is formed forwardly and a parallel long rear vertical wall 22 is formed rearwardly. Short parallel vertical side walls 24, 26 are formed between the front and rear walls. The walls define a rectilinear large chamber 28. Each of the vertical walls has an upper edge 30 terminating at the open top.

An imperforate rectangular lid 34 is provided. The lid is operatively coupled with respect to the box. The lid is adapted to removably cover the open top of the box. The lid has a rear edge 36 with a hinge 38. The hinge is coupled to the upper edge of the rear wall of the box. In association with the lid is a fixed hook and loop fastener 40 on the exterior surface of the front wall. A co-operable movable hook and loop fastener 42 is provided. The movable hook and loop fastener depends from the front edge of the lid at a central extent. The fasteners are provided for the purpose of selective coupling. Indicia 44 are formed on the rearward exterior surface of the rear wall for identification of the contents of the box.

Next provided is a plurality of vertical support plates located within the box. A rear plate 48 is included. The rear plate has a rear face secured to the forward face of the rear wall of the box. The rear plate is formed with vertical parallel slots 50. Preferably, the slots are equally spaced along the length of the forward face. Also included is a front plate 52. The front plate has a front face secured to the rearward face of the front wall of the box. The front plate is formed with vertical parallel slots 54. Preferable, the slots are equally spaced along the length of the rearward face. Further included is an intermediate plate 56. The intermediate plate is located parallel with and equally spaced from the front plate and the rear plate. The intermediate plate has vertical slots 58, 60 on its forward face and rearward face. The plates, front, back and intermediate, each have slots in alignment with and parallel with the associated slots of the associated plates.

Next provided is a plurality of vertical dividers 64 within the box. Each of the dividers has a lower edge 66. The lower edge is positionable on the bottom wall of the box. Each divider also has an upper edge 68. The upper edge is adjacent to open top of the box. Each also has lateral edges 70, 72. The lateral edges are slidably received in a preselected opposed pair of the slots. One lateral edge is in a slot of the intermediate plate and an adjacent plate, either a front plate or a rear plate. In this manner, a small chamber between adjacent dividers is formed. The size of each small chamber depends on the positioning of the dividers within the slots as determined by the user for a practical application. The size of the small chambers may be varied as desired. The box and its components may be fabricated of any rigid material, such as plastic, wood or metal.

Last provided is a plurality of envelopes 76. The envelopes are adapted to receive merchants' copies of daily transaction slips. The transaction slips may be for credit cards and/or debit cards. Preferably, the size of the envelopes is less than an associated one of the small chamber. In this manner, the envelope may be received between the adjacent dividers. Indicia 78 is preferably formed on each envelope. The presence or absence of indicia is at the user's discretion as it for identification purposes.

Figure 9:
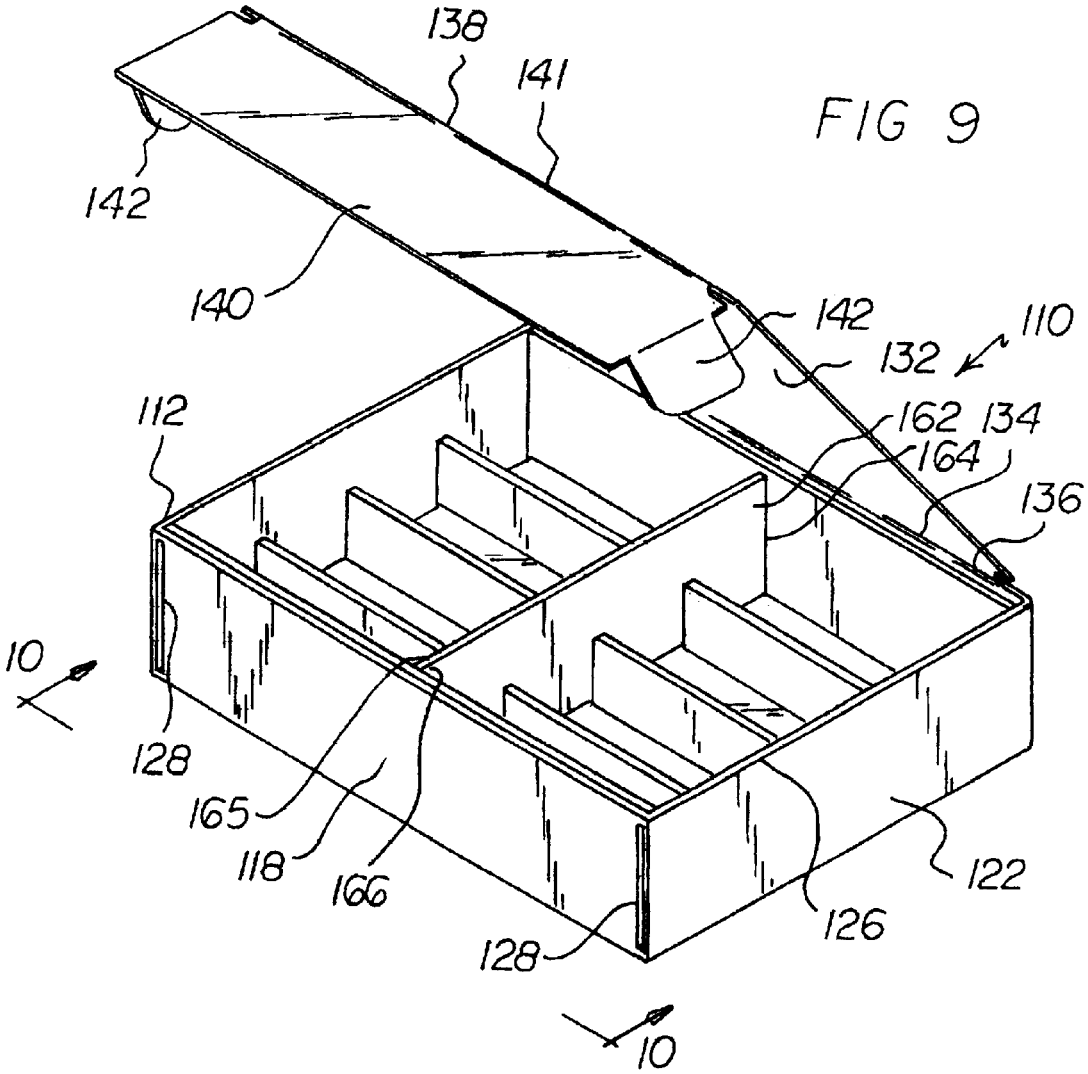
FIG. 9 is a perspective illustration of the alternate embodiment.
Figure 10:
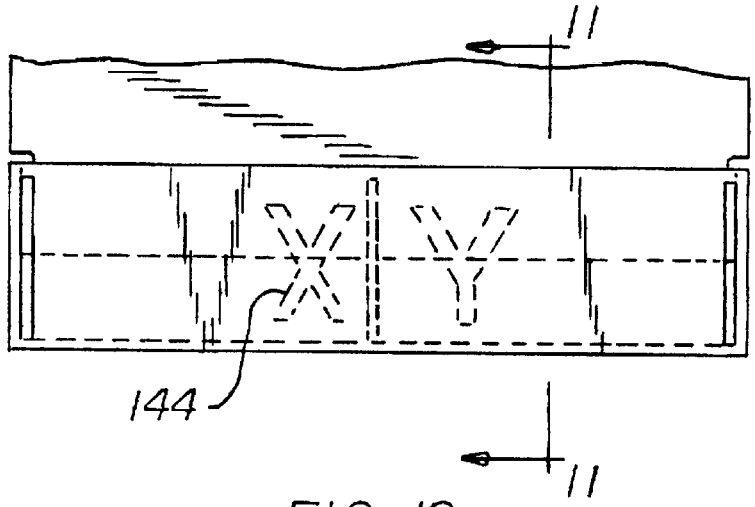
FIG. 10 is a front elevational view of the system shown in FIG. 8A taken along line 10—10 of FIG. 9.
Figure 13:
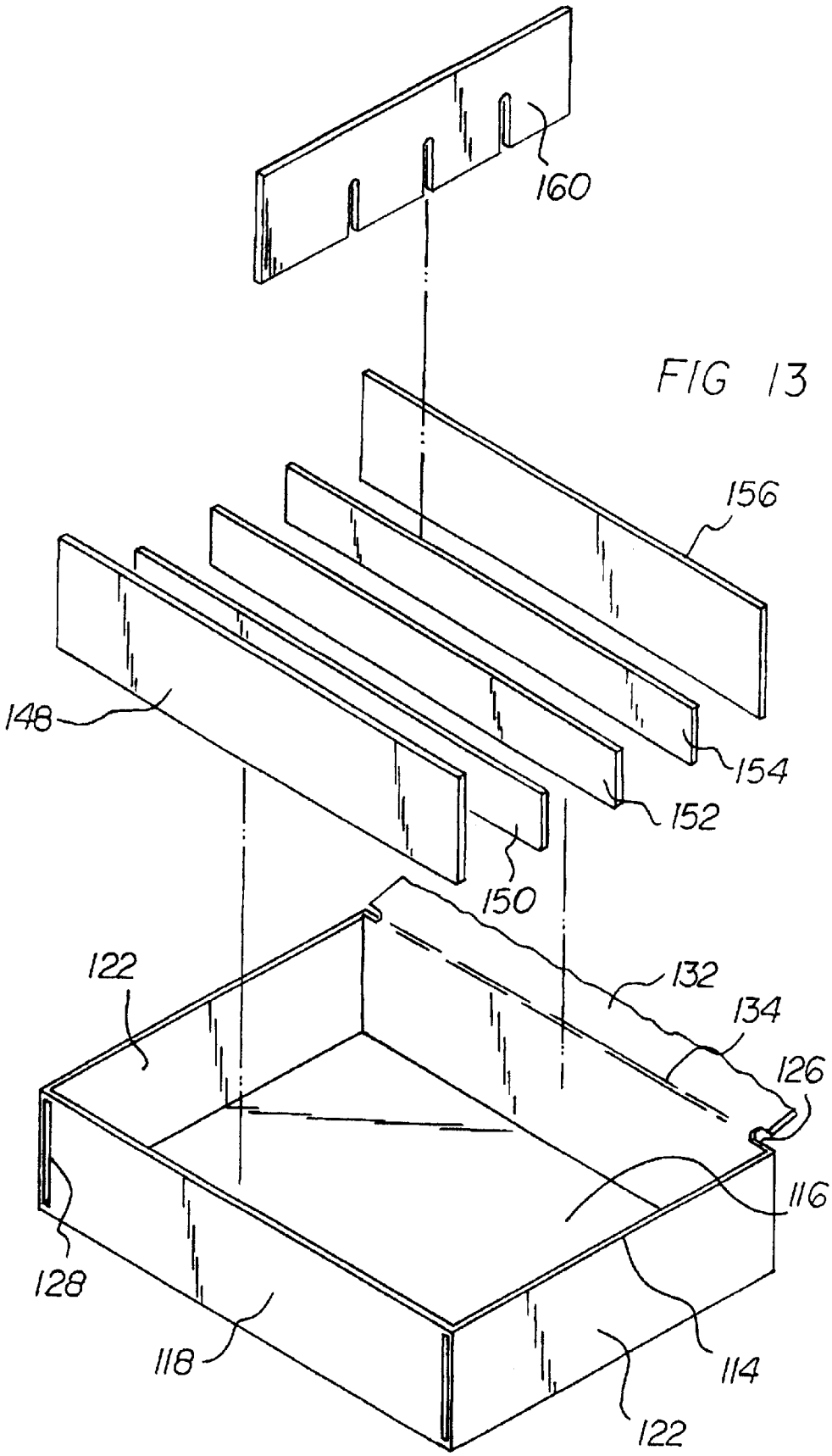
FIG. 13 is an exploded view of the perspective view of the system shown in FIG. 9.

A transaction slip organizer system 110 for providing proper storage and retrieval of merchants' copies of transaction slips for credit cards and debit cards is an alternate embodiment of the present invention. The alternate embodiment is shown in FIGS. 9 through 13.

First provided is a rectilinear box 112. The rectilinear box has a rectangular open top 114 and a rectangular horizontal lower imperforate bottom wall 116. The box also has a long vertical front wall 118 forwardly and a parallel long rear vertical wall 120 rearwardly. Short parallel vertical side walls 122 are provided between the front and rear walls to define a rectilinear large chamber 124. Each of the vertical walls has an upper edge 126 terminating at the open top. The front wall has side edges with vertical slots 128 adjacent to the side walls.

An imperforate rectangular lid 132 is further provided. The lid is adapted to selectively cover and uncover the open top. The lid has a rear edge 134. The rear edge has a hinge 136 coupled to the upper edge of the rear wall of the box. The lid also has a front edge 138. The front edge has a flap 140 and a hinge 141 coupled between the flap and the front edge and has side edges. The side edges have flanges 142 adjacent to the thereto. The flanges are adapted to removably reside in the associated slots of the box when the lid is in a closed orientation. Indicia 144 are formed on the rearward exterior surface of the rear wall.

Also provided are five vertical plates 148, 150, 152, 154 and 156. The five vertical plates are a first vertical plate 148, a last vertical plate 156 and three intermediate plates 150, 152, 154. Each vertical plate has a lower edge positionable on the bottom wall of the box and side edges adjacent the side wall of the box. The first plate and the last plate each have an upper edge adjacent to the open top of the box and intermediate plates. Each intermediate plate has an upper edge extending upwardly to a distance less than the open top.

Even further provided is a vertical support divider 160. The vertical support divider is located within the box. The divider includes a rear edge 162. The rear edge is secured by an adhesive 164 to the first plate 148. In a similar fashion, the front edge 165 is secured by an adhesive 166 to the last plate 156. The divider is formed with vertical parallel slots equally spaced along a bottom portion. The support divider is adapted to lie between the first plate and last plate. The slots receive the intermediate plates. In this manner, all the plates and the support divider retain a vertical configuration with two rows of small chambers 170 with four small chambers in each row.

Last provided is a plurality of envelopes 174. The envelopes are adapted to receive merchants' copies of daily transaction slips for credit cards and debit cards. The envelopes are of a size less than one of the associated small chambers. This allows the envelopes to be received between adjacent plates. Indicia are formed on each envelope for identification purposes.

The purpose of the this invention is to provide proper storage and retrieval of merchants' copies of credit card and debit card daily transaction slips. The number of such transactions everyday varies widely from between merchants. It can range from a couple of transactions to hundreds, or even none.

The merchant's copy is a very important document to him. It is legally binding on the customer and the credit card company to forward the funds to the merchant. It also carries the customer's original signature. The signature is expected to match the signature on the back of the card and, once swiped through the merchant's terminal, serves as proof that the card was in the store through a special symbol that appears on such slips.

At the end of the day, most merchants "close" their batch. This means, the funds generated during the daily transactions are electronically transferred to the merchant's bank account. With the slips, the merchant will receive a terminal report and a bank report confirming the closing. Each merchant saves these reports with the transaction slips his manner. If, for any reason, a cardholder disputes a transaction appearing on his credit card statement, the card issuing company refers the dispute back to the merchant and asks him to provide a copy of the original slip pertaining to that transaction within a few business days. If the merchant fails to provide such proof, he will lose the money associate with that transaction.

Track records show that such retrieval requests happen on a regular basis with all kinds of businesses. This makes is very important to all merchants to have easy access to records in such a way that they can retrieve them, hassle free, within a few seconds or minutes.

Many merchants continue to lose money because they have no way to archive these records in a proper manner that warrants an easy access and retrieval process.

To fill this need, came the idea of creating this invention. It is simple and involves basic common sense. Each daily batch that includes the transaction slips along with the terminal and bank reports get stored in a bag/envelope inside a box. As shown in the attached figures, bags/envelopes are stored vertically on their sides separated from each other by the cardboard dividers. The bag/envelope length and width, as designed, can accommodate any size of the different transaction slips available in today's market. The batch thickness for any day may vary from 1/32-inch to 1-inch depending on the business volume and size of credit and debit activity throughout the business day. On the odd occasion, if any at all, where there is more that 1-inch of slips, the merchant can use more than one bag/envelope and store them together. Separators get inserted after each bag/envelope is set in and secured in place as they snap inside the 1/16-inch slots or dents on the central sidetracks. As shown in the figures, there is a place for a divider at 4/16-inch intervals, thus absorbing the variation in bag/envelope thickness. When the box is filled with bags/envelopes, the merchant archives it and starts using another one. With the dates written on the top right corner of each bag, a bag pertaining to a certain day can be located in a manner of seconds. Also, the information shown on the outside of the box makes it very quick and easy for the merchant to pick up the box that carries the slips pertaining to the desired date.

All dimensions mentioned here above are approximate and will be subject to final revision. This invention shall be manufactured using cardboard, paper and molded plastic for side and central tracks. Final decision on materials shall be set after consulting with potential manufactures.

Our estimate is that this product brings a very small expense to the business that uses it, however, it brings a great deal of peace of mind and saves lots of time.

It is believed that any business that accepts credit cards and debit cards would benefit from the use of this invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A transaction slip organizer system for providing proper storage and retrieval of merchants' copies of transaction slips for credit cards and debit cards comprising, in combination:

a rectilinear box having a rectangular open top and a rectangular horizontal lower imperforate bottom wall and a long vertical front wall forwardly and a parallel long rear vertical wall rearwardly and with short parallel vertical side walls there between to define a rectilinear large chamber there within, each of the vertical walls having an upper edge terminating at the open top;

an imperforate rectangular lid adapted to removably cover the open top, the lid having a rear edge with a hinge coupled to the upper edge of the rear wall of the box and with a fixed hook and loop fastener on the exterior surface of the front wall and a movable hook and loop fastener depending from the front edge of the lid for selective coupling purposes, and with indicia formed on the rearward exterior surface of the rear wall;

a plurality of vertical support plates located within the box, the plates include a rear plate having a rear face secured to the forward face of the rear wall of the box and formed with vertical parallel slots equally spaced along the length of the forward face thereof and a front plate having a front face secured to the rearward face of the front wall of the box and formed with vertical parallel slots equally spaced along the length of the rearward face thereof and with an intermediate plate located parallel with and equally spaced from the front plate and the rear plate, the intermediate plate having vertical slots on both its forward face and rearward face with the slots of all of the plates being in alignment and parallel with associated slots of the front and rear plates;

a plurality of vertical dividers, each having a lower edge positionable on the bottom wall of the box and having an upper edge adjacent to the open top of the box and having lateral edges slidably received in a preselected opposed pair of the slots between the intermediate plate and an adjacent plate to define a small chamber between adjacent dividers, each small chamber being of a size depending upon the positioning of the dividers within the slots; and a plurality of envelopes adapted to receive the merchants' copies of daily transaction slips for credit cards and debit cards, the envelopes being of a size less than an associated one of the small chambers so as to be received between adjacent dividers and with indicia formed on each envelope for identification purposes.

2. A transaction slip organizer system comprising:

a rectilinear box having a rectangular open top and a rectangular lower imperforate bottom wall and a front wall forwardly and a parallel rear wall rearwardly and with parallel side walls there between to define a rectilinear large chamber there within, each of the walls having an upper edge terminating at the open top;

a plurality of support plates located within the box, the plates include a rear plate having a rear face secured to the forward face of the rear wall of the box and formed with parallel slots spaced along the length of the forward face thereof and a front plate having a front face secured to the rearward face of the front wall of the box and formed with parallel slots equally spaced along the length of the rearward face thereof and an intermediate plate located parallel with and spaced from the front plate and the rear plate, the intermediate plate having slots on both its forward face and rearward face with the slots of all of the plates being in alignment and parallel with associated slots of the front and rear plates;

a plurality of dividers, each having a lower edge positionable on the bottom wall of the box and having an upper edge adjacent to the open top of the box and having lateral edges slidably received in a preselected opposed pair of the slots between the intermediate plate and an adjacent plate to define a small chamber between adjacent dividers; and a plurality of envelopes adapted to receive merchants' copies of daily transaction slips for credit cards and debit cards, the envelopes being of a size less than an associated one of the small chambers so as to be received between adjacent dividers and with indicia formed on each envelope for identification purposes.

3. The system as set forth in claim 2 and further including an imperforate rectangular lid adapted to removably cover the open top, the lid having a rear edge with a hinge coupled to the upper edge of the rear wall of the box and with a fixed hook and loop fastener on the exterior surface of the front wall and a movable hook and loop fastener depending from the front edge of the lid for selective coupling purposes, and with indicia formed on the rearward exterior surface of the rear wall.

4. A transaction slip organizer system for providing proper storage and retrieval of merchants' copies of transaction slips for credit cards and debit cards comprising, in combination:

a rectilinear box having a rectangular open top and a rectangular horizontal lower imperforate bottom wall and a long vertical front wall forwardly and a parallel long rear vertical wall rearwardly and with short parallel vertical side walls there between to define a rectilinear large chamber there within, each of the vertical walls having an upper edge terminating at the open top, the front wall having side edges with vertical slots there along adjacent to the side walls;

an imperforate rectangular lid adapted to selectively cover and uncover the open top, the lid having a rear edge with a hinge coupled to the upper edge of the rear wall of the box and the lid also having a front edge with a flap and a hinge coupled between the flap and the front edge and having side edges with flanges adjacent thereto adapted to removably reside in the associated slots of the box when the lid is in a closed orientation and with indicia formed on the rearward exterior surface of the rear wall;

a first vertical plate and a last vertical plate and three intermediate plates, each having a lower edge positionable on the bottom wall of the box and side edges adjacent the side wall of the box and the first plate and the last plate each having an upper edge adjacent to the open top of the box and each intermediate plates having an upper edge extending upwardly to a distance less than the open top;

a vertical support divider located within the box, the divider includes a rear edge secured by an adhesive to the first plate and a front edge secured by an adhesive to the last plate and the divider being formed with vertical parallel slots equally spaced along a bottom portion thereof, the support divider being adapted to lie between the first plate and last plate with the slots receiving the intermediate plates such that all the plates and support divider retain a vertical configuration with two rows of small chambers with four small chambers in each row; and a plurality of envelopes adapted to receive the merchants' copies of daily transaction slips for credit cards and debit cards, the envelopes being of a size less than one of the associated small chambers so as to be received between adjacent plates and with indicia formed on each envelope for identification purposes.

5. A transaction slip organizer system comprising:

a rectilinear box having a rectangular open top and a rectangular lower imperforate bottom wall and a front wall and a parallel rear wall and with parallel side walls there between to define a rectilinear large chamber there within, each of the walls having an upper edge terminating at the open top;

a plurality of plates located within the box, the plates include a pair of end plates comprising a rear plate having a rear face secured to the forward face of the rear wall of the box and a front plate having a front face secured to the rearward face of the front wall of the box and a plurality of intermediate plates located parallel with and spaced from the front plate and the rear plate;

at least one divider having a lower edge positionable on the bottom wall of the box and an upper edge adjacent to the open top of the box and at least one lateral edge; the at least one divider and the plates cooperating to define a plurality of small chambers; and a plurality of envelopes adapted to receive merchants' copies of daily transaction slips for credit cards and debit cards, the envelopes being of a size less than an associated one of the small chambers so as to be received between adjacent plates and with indicia formed on each envelope for identification purposes.

* * * * *